US006019210A

United States Patent [19]

Matsunaga et al.

[11] Patent Number: 6,019,210

[45] Date of Patent: Feb. 1, 2000

[54] WARMING-UP TYPE BILL VALIDATOR

[75] Inventors: Kensuke Matsunaga; Masahiro Motohara; Takeshi Mitsuma, all of Osaka, Japan

[73] Assignee: Japan Cash Machine Co., Ltd., Osaka, Japan

[21] Appl. No.: 09/116,033

[22] Filed: Jul. 15, 1998

[51] Int. Cl.[7] ..... G07D 7/00

[52] U.S. Cl. ..... 194/206

[58] Field of Search ..... 194/206, 207; 198/952

[56] References Cited

U.S. PATENT DOCUMENTS 4,348,656 9/1982 Gorgone et al. ..... 194/213 X 4,988,854 1/1991 Mita ..... 235/476

*Primary Examiner*—F. J. Bartuska

*Attorney, Agent, or Firm*—Bachman & LaPointe, P.C.

[57] ABSTRACT

A temperature sensor 51 is provided in the bill validator according to the present invention to produce a detection signal when a temperature in the case 11 is lowered below a predetermined level. Upon occurrence of the detection signal of the temperature sensor 51, a first timer starts counting a confirmative period of time. When the first timer counts up the confirmative period of time, a second timer produces a drive signal to activate the conveyer motor 38 for a predetermined warming-up period of time. As the conveyer motor 38 is rotated for warming-up, the belt 23 runs in the case 11 to revive its flexibility and generate heat due to dynamic friction of the mechanic parts including the conveyer motor 38, pulleys 21, 22 and belt 23 during rotation of the conveyer motor 38.

7 Claims, 3 Drawing Sheets

WARMING-UP TYPE BILL VALIDATOR

FIELD OF THE INVENTION

This invention relates to a bill validator, in particular a warming-up type bill validator capable of preventing breakdown or failure of the bill validator resulted from cold air.

PRIOR ART

Bill validators have been used in vending machines, money exchangers, bill dispensers or other kind of many bill handling machines all over the countries. A typical bill validator comprises a case having an inlet into which a bill is inserted and an outlet from which the bill is discharged; an inlet sensor for detecting insertion of the bill into the inlet; a conveyer device for transporting the bill from the inlet to the outlet through a passageway in the case; a bill sensor disposed adjacent to the passageway for converting into electric signals optical or magnetic feature of the bill; and a validating control circuit electrically connected with the inlet sensor, conveyer device and bill sensor for driving the conveyer device. When the bill is inserted into the inlet, the inlet sensor products a detection signal to the validating control circuit which starts rotation of a motor of the conveyer device. Therefore, the bill is transported from the inlet toward the outlet by a flexible conveyer belt along the passageway so that the bill sensor converts into electric signals optical or magnetic feature of the bill moving through the passageway. The conveyer belt is wound around and moved by pulleys rotated by the motor. The validating control circuit compares output signals from the bill sensor with an optical or magnetic pattern previously stored in the validating control circuit. If the output signals from the bill sensor are correspondent to the stored pattern, the validating control circuit forwards a drive signal to the conveyer device to transport the bill to the outlet so that the bill is sent to a stacker for accumulation after discharged from the outlet. Adversely, if the output signals from the bill sensor are not correspondent to the stored pattern, the validating control circuit forwards a different drive signal to the conveyer device to return the bill to the inlet.

In some cases, bill validators are broken down in cold districts because the conveyer belt is hardened under the low atmospheric temperature so that the belt cannot return to its flexible property for smooth rotation when the conveyer device is suddenly driven after it is paused in cold atmosphere for a long time. In particular, a congealed curved portion of the belt wound around the pulley cannot be deformed into its straight shape for rotation, thereby causing breakdown or failure of the conveyer device. In addition, below the freezing point of atmospheric temperature, ice is deposited on parts within the bill validator, and it may result in trouble of the bill validator.

An object of the present invention is to provide a bill validator that can prevent breakdown or failure thereof resulted from cold air by performing appropriate warming-up operation.

Another object of the invention is to provide a bill validator which can be well operated in a cold atmosphere without a heater.

A still another object of the invention is to provide a bill validator whose inside can always be kept in good condition for smooth operation at low atmospheric temperature.

SUMMARY OF THE INVENTION

The bill validator according to the present invention comprises a case having an inlet into which a bill is inserted and an outlet from which the bill is discharged; an inlet sensor for detecting insertion of the bill into the inlet; a conveyer device for transporting the bill from the inlet to the outlet through a passageway in the case; a bill sensor disposed adjacent to the passageway for converting into electric signals optical or magnetic feature of the bill moving through the passageway; and a validating control circuit electrically connected with the inlet sensor, conveyer device and bill sensor for driving the conveyer device. The conveyer device has a belt for transporting the bill along the passageway and a conveyer motor drivingly connected with the belt. The bill validator further comprises a temperature sensor for producing a detection signal when a temperature in the case is lowered below a predetermined level; a first timer for starting counting a confirmative period of time upon receiving the detection signal from the temperature sensor, and a second timer for producing a drive signal when the first timer counts up the confirmative period of time to drive the conveyer motor for a predetermined warming-up period of time.

When the temperature in the case is lowered below the predetermined level, the temperature sensor produces a detection signal which lets the first timer start counting a confirmative period of time. When counts up the confirmative period of time, the first timer produces an output by which the second timer produces a drive signal to activate the conveyer motor for a predetermined warming-up period of time. As the conveyer motor is rotated for run-in or warming-up, the belt runs in the case to revive its flexibility and generate heat due to dynamic friction of the mechanic parts including the conveyer motor, pulleys and belt during rotation of the conveyer motor. Thus, the warming-up operation can prevent hardening of the belt and elevate the interior temperature of the case to an appropriate level without a heater.

In an embodiment of the present invention, the conveyer motor may be rotated in the reverse direction by the drive signal of the second timer. The temperature sensor comprises an electrical sensor of a thermostat or a temperature-sensitive capacitor or a mechanical sensor of a bimetal or a shape memory alloy. The operation of the conveyer motor can be stopped when the temperature sensor decides that the interior of the case is warmed to a predetermined temperature during the warming-up period of time.

BRIEF DESCRIPTION OF THE DRAWINGS

A more complete understanding of the present invention may be derived by reference to the detailed description and the claims when considered together with the accompanying drawings wherein:

DETAILED DESCRIPTION OF THE INVENTION

Figure 1:
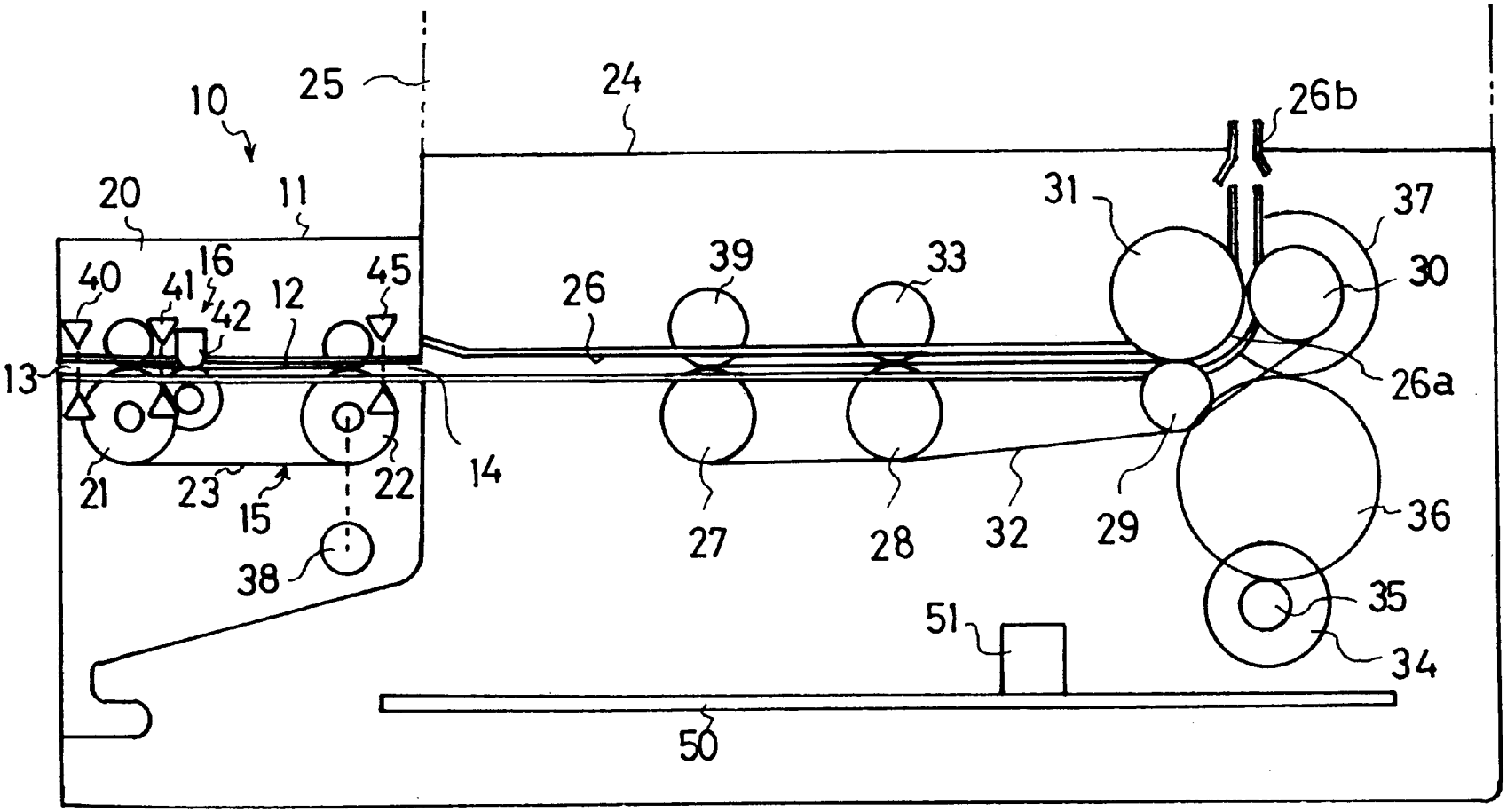
FIG. 1 is a cross-sectional view of a bill validator according to the present invention.

An embodiment of the present invention will be described hereinafter referring to FIGS. 1 to 3.

A bill validator 10 of this invention comprises a case 11 having an inlet 13 into which a bill is inserted and an outlet 14 from which the bill is discharged; an inlet sensor 40 provided adjacent to the inlet 13 for detecting insertion of the bill into the inlet 13; a conveyer device 15 for transporting the bill from the inlet 13 to the outlet 14 through a passageway 12 in the case 11; a bill sensor 16 disposed adjacent to the passageway 12 for converting into electric signals optical or magnetic feature of the bill moving through the passageway 12. The bill validator 10 forms a validating unit 20 removably attached to a transport apparatus 24.

The bill sensor 16 comprises infrared ray optical sensor 41 for picking up optical features of the bill and a magnetic sensor 42 for detecting magnetic features of the bill. An outlet sensor 45 is provided adjacent to the outlet 14 of the passageway 12 to detect discharge of the bill. The conveying device 15 comprises a pair of pulleys 21, 22; and a belt 23 wound around the pulleys 21, 22. The pulley 22 is operatively connected to a conveyer motor 38 to drive the belt 23 so that a bill is transported by the belt 23 from the slot 13 to the outlet 14. Not shown but a rotary encoder is attached to the conveyer motor 38 to detect rotation of the conveyer motor 38. The passageway 12 formed by the conveying device 15 is aligned with a carrier passage 26 formed in a transport apparatus 24 which comprises pulleys 27, 28, 29, 30 and 31 provided adjacent to the carrier passage 26, and a belt 32 wound around the transporting pulleys 27 to 31 so that the bill discharged from the outlet 14 of the bill validator 10 is continuously carried by the transport apparatus 24. The pulleys 27, 28 and 29 are rotatably mounted so that their upper surfaces are positioned nearly on a same plane toward push rollers 39, 33 and the pulley 31. A transport motor 34 has an output shaft to which a pinion 35 is mounted in engagement with an intermediate gear 36. An output gear 37 is meshed with the intermediate gear 36 for rotation together with the drive pulley 30 disposed outside an upwardly bent area 26*a* of the carrier passage 26 to smoothly drive the belt 32 along the bent area 26*a* of the carrier passage 26 to travel the bill through the bent area 26*a* and exit 26*b* into a stacker 25. A printed circuit board 50 is disposed in the transport apparatus 24 to support a temperature sensor 51 which produces a detection signal when an interior temperature of the case 11 is lowered below a predetermined level, for example zero degree. To this end, the temperature sensor 50 may be selected from an electrical sensor of a thermostat or a temperature-sensitive capacitor or a mechanical sensor of a bimetal or a shape memory alloy.

Figure 2:
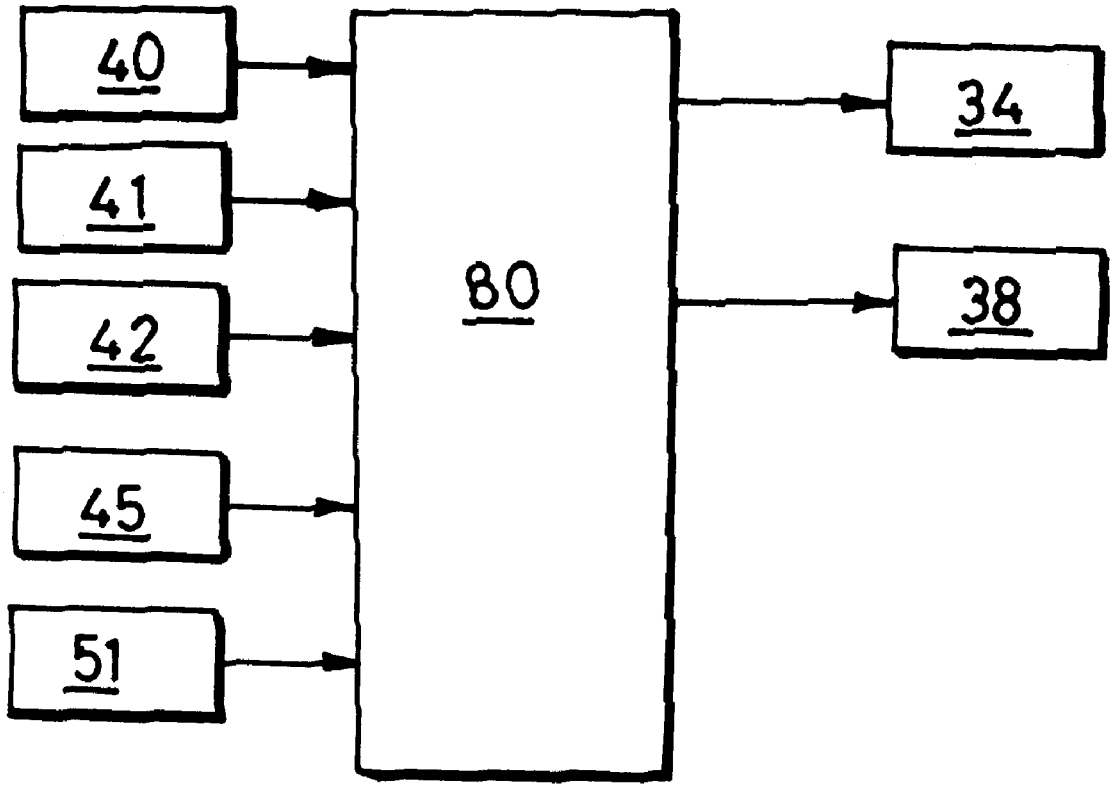
FIG. 2 is a block diagram showing an electric circuit used in the bill validator of this invention.

As shown in FIG. 2, the inlet sensor 40, infrared ray optical sensor 41, magnetic sensor 42, outlet sensor 45 and temperature sensor 51 are electrically connected with each corresponding input terminal of a validating control circuit 80. The rotary encoder attached to the conveyer motor 38 is also electrically connected with the control circuit 80 which counts the pulses from the rotary encoder to detect rotation of the conveyer motor 38. Each output terminal of the validating control circuit 80 is connected with the transport motor 34 and conveyer motor 38. Not shown but, the validating control circuit 80 comprises first and second timers formed by programmed control in the validating control circuit 80. Upon receiving the detection signal from the temperature sensor 51, the first timer starts counting a confirmative period of time for example fifteen minutes and produces an output when counts up the confirmative period of time. When the first timer counts up the confirmative period of time or generates the output, the second timer produces a drive signal to activate the conveyer motor 38 for a predetermined warming-up period of time for example five seconds.

Figure 3:
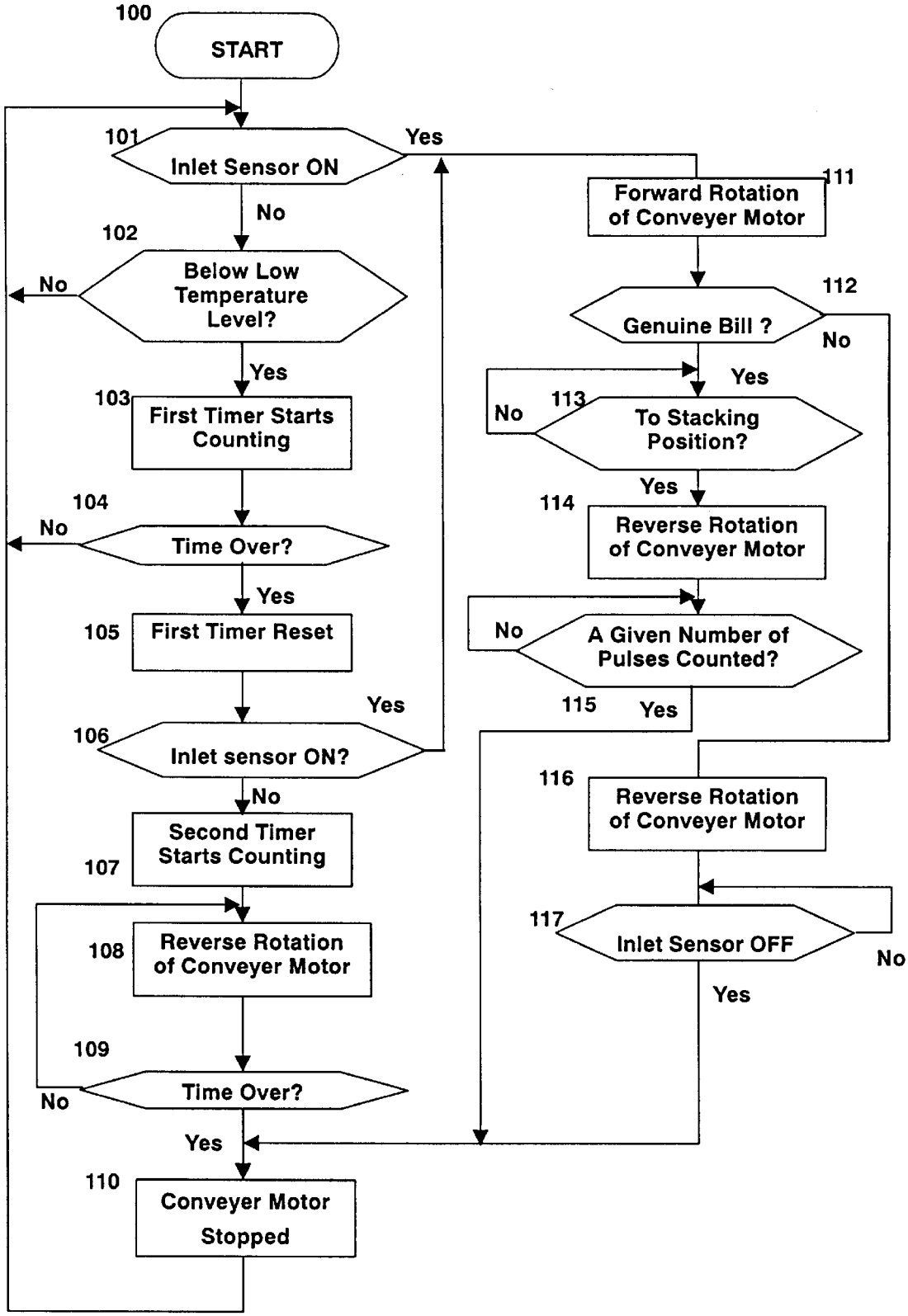
FIG. 3 is a flow chart showing an operational sequence of the electric circuit.

The bill validator of the present invention is worked in accordance with an operational sequence shown in flow chart of FIG. 3.

The processing moves from "START" of Step 100 to Step 101 wherein the validating control circuit 80 judges by the output of the inlet sensor 40 whether a bill is inserted or not. If this is negative, the treatment goes to Step 102 wherein the validating control circuit 80 decides by the output of the temperature sensor 51 whether the temperature in the case 11 is lowered below a predetermined level by cold atmosphere. In this case, if the temperature in the case 11 is lowered below the predetermined level, the temperature sensor 51 produces a detection signal to the first timer which thereby starts counting a confirmative period of time (Step 103). In Step 104, the control circuit 80 make a decision whether the first timer counts up the confirmative period of time to confirm that the inside of the case 11 is continuously below the predetermined low temperature for the certain period of time. When the first timer counts up the confirmative period of time in Step 104, it produces an output and then is reset (Step 105). Thereafter, the processing advances to Step 106 wherein the validating control circuit 80 determines whether the inlet sensor 40 is turned "ON" or not by inserting a bill into the inlet 13. When the inlet sensor 40 is in the "OFF" condition in Step 106, in accordance with generation of the output from the first timer, the second timer produces a drive signal in Step 107 so that the conveyer motor 38 is rotated in the reverse direction for a given warming-up period of time in Step 108 by the drive signal of the second timer. As the conveyer motor 38 is rotated for warming-up, the belt 23 runs in the case 11 to revive flexibility of the belt 23 and generate heat due to dynamic friction of the mechanic parts including the conveyer motor 38, pulleys 21, 22 and belt 23 during rotation of the conveyer motor 38. Thus, the warming-up operation can prevent hardening of the belt 23 and elevate the interior temperature of the case 11 to an appropriate level without a heater. In Step 109, the control circuit 80 decides whether the second timer counts up the predetermined warming-up period of time. When the period of time is over in Step 109, operation of the conveyer motor 38 is stopped in Step 110 and the processing returns to Step 101. When the temperature in the case 11 is not lowered below a predetermined level in Step 102 or when the first timer does not count up the confirmative period of time in Step 104, the stage is returned to Step 101. When the second timer does not count up the given warming-up period of time in Step 109, the process returns to Step 108.

When the inlet sensor 40 is turned "ON" in Step 101 or 106, the control circuit 80 supplies drive signals to the conveyer motor 38 which therefore is rotated in the forward direction to transport the bill along the passageway 12. The bill sensor 16 detects optical or magnetic features of the bill moving along the passageway 12 so that the control circuit 80 judges from the output of the bill sensor 16 in Step 112 whether the bill is genuine or not. If this is affirmative, the bill is moved to a stacked position (Step 113). Then, the conveyer motor 34 is rotated in the reverse direction (Step 114) for stacking operation of the bill into the stacker 25. The control circuit 80 determines whether it counts up a predetermined number of pulses from the rotary encoder connected with the conveyer motor 38 in Step 115 to confirm completion of the stacking operation. When the control circuit 80 counts up the predetermined number of pulses, the process goes to Step 110. When the bill is considered not genuine in Step 112, the control circuit 80 drives the conveyer motor 38 in the adverse direction in Step 116, and when it concludes that the inlet sensor 40 is turned "OFF" in Step 117, the processing goes to Step 110.

The embodiment of this invention is not limited to the foregoing example and modifications can be made in the embodiment. For example, the transport motor 34 as well as the conveyer motor 38 may simultaneously be driven for warming-up when no bill is inserted. However, usually warming-up operation of only the conveyer motor 38 for the given period of time is enough to prevent breakdown of the bill validator 10 under low temperature because the conveyer motor 38 is very close to the inlet 13 through which cold air enters the validator 10.

The confirmative period of time may vary for example from 20 seconds to an hour, and the warming-up period of time may vary for example from three seconds to fifteen minutes as required. The temperature sensor 51 can detect a temperature ranging between for example zero to five degrees. The validating control circuit 80 can be so designed that the operation of the conveyer motor 38 can be stopped to Step 110 without Step 109 when the validating control circuit 80 decides by output of said temperature sensor 51 that the interior of the case 11 is warmed to a predetermined temperature for example 10° C. in Step 108 during the warming-up period of time. Otherwise, the conveyer motor 38 can be rotated in the forward direction to Step 111 when the validating control circuit 80 decides by output of the inlet sensor 40 that a bill is inserted into the inlet 13 during the warming-up period of time.

As above-mentioned, the warming-up operation of the bill validator according to the present invention can realize that the inside of the case is heated to an appropriately elevated temperature and kept over a given temperature level. Therefore, the bill validator can always be operated in optimal condition, avoiding breakdown or trouble of the validator caused by internal freeze.

What is claimed is:

1. In a bill validator comprising a case having an inlet into which a bill is inserted and an outlet from which the bill is discharged; an inlet sensor for detecting insertion of the bill into the inlet; a conveyer device for transporting the bill from the inlet to the outlet through a passageway in the case; a bill sensor disposed adjacent to said passageway for converting into electric signals optical or magnetic feature of the bill moving through the passageway; and a validating control circuit electrically connected with the inlet sensor, conveyer device and bill sensor for driving the conveyer device; said conveyer device having a belt and a conveyer motor drivingly connected with said belt; the improvement comprising:

a temperature sensor for producing a detection signal when a temperature in said case is lowered below a predetermined level; a first timer for starting counting a confirmative period of time upon receiving the detection signal from said temperature sensor, and a second timer for producing a drive signal when said first timer counts up said confirmative period of time to drive said conveyer motor for a predetermined warming-up period of time.

2. The bill validator of claim 1, wherein said conveyer motor is rotated in the reverse direction by the drive signal of said second timer.

3. The bill validator of claim 1, wherein said temperature sensor comprises an electrical sensor of a thermostat or a temperature-sensitive capacitor or a mechanical sensor of a bimetal or a shape memory alloy.

4. The bill validator of claim 1, wherein said first timer is reset when counts up the confirmative period of time.

5. The bill validator of claim 1, wherein said first timer produces an output when counts up the confirmative period of time, and upon receiving the output from the first timer, said second timer produces the drive signal to activate said conveyer motor for a predetermined warming-up period of time.

6. The bill validator of claim 1, wherein operation of said conveyer motor can be stopped when said validating control circuit decides by output of said temperature sensor that the interior of said case is warmed to a predetermined temperature during the warming-up period of time.

7. The bill validator of claim 1, wherein said conveyer motor can be rotated in the forward direction when the validating control circuit decides by output of said inlet sensor that a bill is inserted into said inlet during the warming-up period of time.

* * * * *